US007618358B2

(12) United States Patent
Traub et al.

(10) Patent No.: US 7,618,358 B2
(45) Date of Patent: Nov. 17, 2009

(54) TRAINING DEVICE

(75) Inventors: Barry H Traub, Dunwoody, GA (US); Bruno Montanari, Forli (IT)

(73) Assignees: Sportime, LLC, Norcross, GA (US); Trial, S.R.L., Forli (IT)

( * ) Notice: Subject to any disclaimer, the term of this patent is extended or adjusted under 35 U.S.C. 154(b) by 0 days.

(21) Appl. No.: 11/365,973

(22) Filed: Mar. 1, 2006

(65) Prior Publication Data

US 2007/0207901 A1 Sep. 6, 2007

(51) Int. Cl.
*A63B 22/14* (2006.01)
*A63B 21/00* (2006.01)

(52) U.S. Cl. ..... 482/147; 482/92

(58) Field of Classification Search ..... 482/92, 482/146–147, 79–80, 51, 77
See application file for complete search history.

(56) References Cited

U.S. PATENT DOCUMENTS 2,991,589 A * 7/1961 Ayala ..... 446/192
6,554,753 B1 * 4/2003 Weck et al. ..... 482/147
6,575,885 B1 * 6/2003 Weck et al. ..... 482/147
6,740,008 B1 * 5/2004 Ho et al. ..... 482/34
6,945,919 B2 * 9/2005 Yang ..... 482/142
7,004,886 B2 * 2/2006 Chen ..... 482/14
D546,907 S * 7/2007 Dykgraaf et al. ..... D21/662

OTHER PUBLICATIONS

Product Reebok Step; www.performbetter.com; downloaded Mar. 8, 2007; pp. 1-2.
Product BOSU Home Balance Trainer; www.bosu.com; downloaded Mar. 8, 2007; p. 1.

* cited by examiner

*Primary Examiner*—Fenn C Mathew
(74) *Attorney, Agent, or Firm*—Nicholas A. Kees; Godfrey & Kahn, S.C.

(57) ABSTRACT

An inflatable training device having a flexible concave shaped dome for stepping on by a user and a base. A portion of the dome wraps around a portion of the base to form a bumper ring that is seated on the floor. The inner area of the dome is filled with air through either a high volume valve located in the base or a low-volume valve in the dome that permits the firmness of the device to be easily adjusted.

11 Claims, 10 Drawing Sheets

TRAINING DEVICE

BACKGROUND OF THE INVENTION

This invention relates generally to physical training devices, and in particular, to a physical training device having a flexible dome top shape.

Various types of exercise devices have been suggested and used to accomplish different aerobic programs. Step exercising is a popular form of exercise for the cardiovascular system. A step exercise routine is one in which a person steps onto and off of an exercise platform in a repeated motion in order to simulate the exercise of walking or running up stairs. Step exercise routines are typically performed at health clubs or other exercise facilities by a group of people who, simultaneously, step onto and off of either the same or different exercise platforms.

The difficulty of the exercise is determined, among other things, by the height of the platform used during the exercise routine. Specifically, the higher the platform, the more difficult the stair-step exercise routine tends to be. Thus, the height of the platform used by any particular individual depends upon that individual's level of skill, endurance and on the amount of workout desired. However, over prolonged use of such devices can cause stress on the knees.

One type of device, commonly known as the Reebok Step®, has a large platform, which the user steps on, and adjusting risers on either end of the platform that adjust to various heights. The stiffness of the Reebok Step® platform, however, which is not adjustable, can cause undue stress on the knees and other joints. Furthermore, the height of the platform is preset prior to use of the device.

Another type of device, the Bosu® Balance Trainer, shown in FIG. 1, seeks to alleviate undue stress on the user's joints. However, the Bosu® Balance Trainer suffers from certain drawbacks and limitations. This device is difficult to properly inflate, has an outer support rim which is thick, rigid and potentially unsafe for the user of the device and provides a limited useable area.

The prior art training devices suffer from certain drawbacks and limitations. Accordingly, a need exists for a training device that is safe, incorporates directional instructions directly on the device, is easily inflated, is easily transported, is relatively inexpensive to manufacture, provides more useable area, and solves other problems associated with the existing training devices. None of the above-mentioned devices, taken either singly or in combination, is seen to describe the present invention as claimed.

SUMMARY OF THE INVENTION

The present invention provides a training device that has a broad range of functionality and overcomes certain of the deficiencies in the prior art. The present invention is a training device comprising a generally circular shaped base that is in close proximity to the floor. The circumference of the base is defined by a generally circular shaped rim. The present invention also incorporates a flexible concave shaped dome that encloses an inner area that is filled with air and an outer surface for stepping on by a user. The dome wraps around the rim of the base and is attached to at least a portion of the bottom surface of the base to form a bumper ring.

In one aspect of the invention there is a first valve located in the center of the base for allowing air to flow into and out of the inner area.

In another aspect of the invention there is a second valve located at the top of the dome that also allows air to flow into and out of the inner area. The second valve preferably permits air to flow into and out of the inner area at a slower rate of speed than the first valve and is easily accessible. In this embodiment, the second valve allows for fine-tuning of the desired air pressure of the training device without the need to turn the entire device over to expose the first valve.

In another aspect of the invention, the dome is designed with directional elements for instructional purposes. For example, the dome can incorporate four numbered quadrants integrated into the dome.

In another aspect of the invention, the surface of the dome is formed with multi-textures of both high traction and low traction. The high traction portions are designed to provide a non-slip surface. Whereas the low traction area is designed to allow users to make modified turns without fear of the soles of their shoes being held too strongly in place by extreme friction.

In yet another aspect of the invention, the dome wraps around the rim of the base and is attached to a portion of the base to create a bumper ring. When the user steps onto the device the air that is trapped between the floor and the concave shaped base is forced out between the floor and the bumper ring, thereby creating a suction effect that assists in holding the training device in place.

Various other features, objects, and advantages of the invention will be made apparent to those of skill in the art from the following detailed description including illustrative examples setting forth how to make and use the invention.

DESCRIPTION OF THE DRAWINGS

A clear understanding of the several features constituting the present invention and of the mode of constructing and of utilizing a preferred embodiment of the present invention may be had by referring to the drawings accompanying and forming a part of this specification, wherein like reference characters designate the same or similar parts in the various views.

DETAILED DESCRIPTION OF THE PREFERRED EMBODIMENTS

Figure 1:
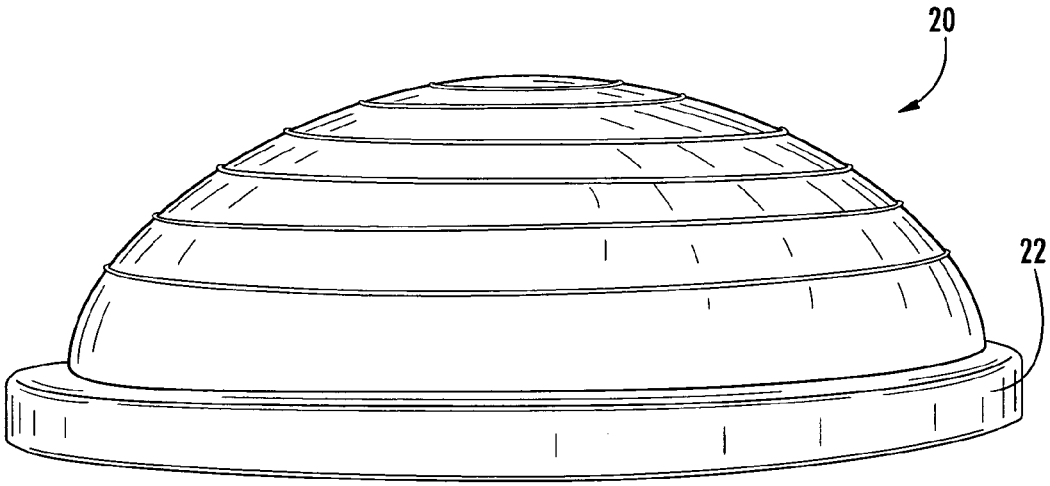
FIG. 1 (PRIOR ART)
FIG. 1 is a side view of a prior art device.
Figure 2:
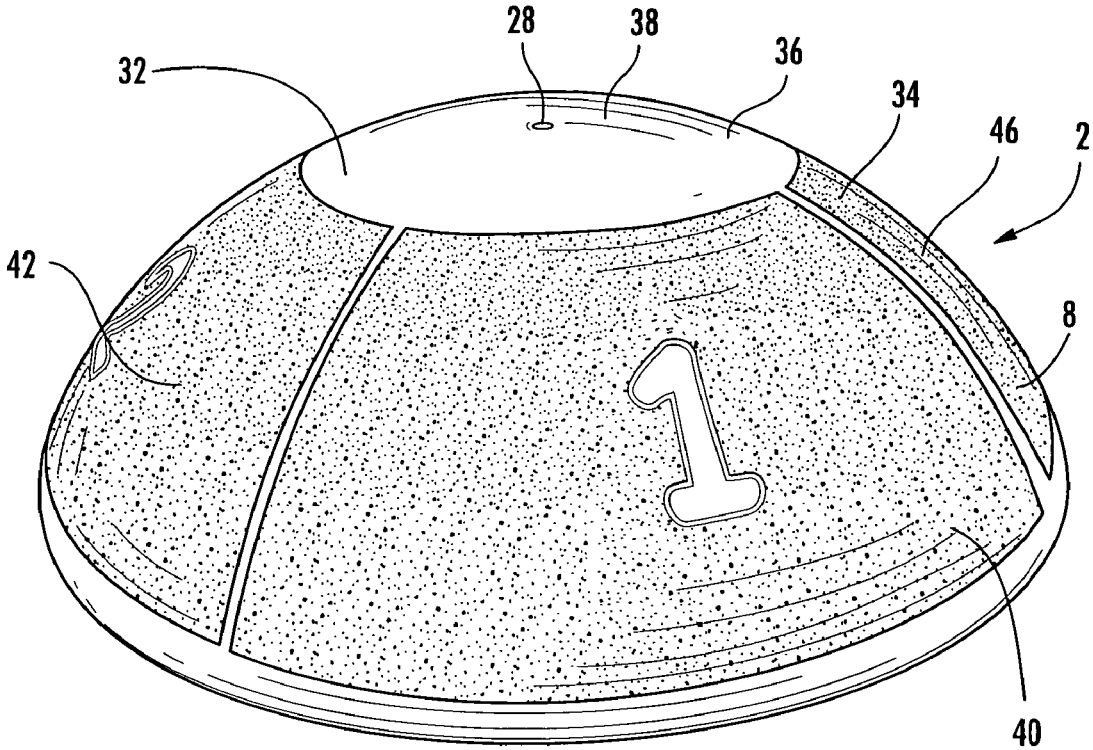
FIG. 2 is a perspective view of one embodiment of the training device according to the present invention.
Figure 3:
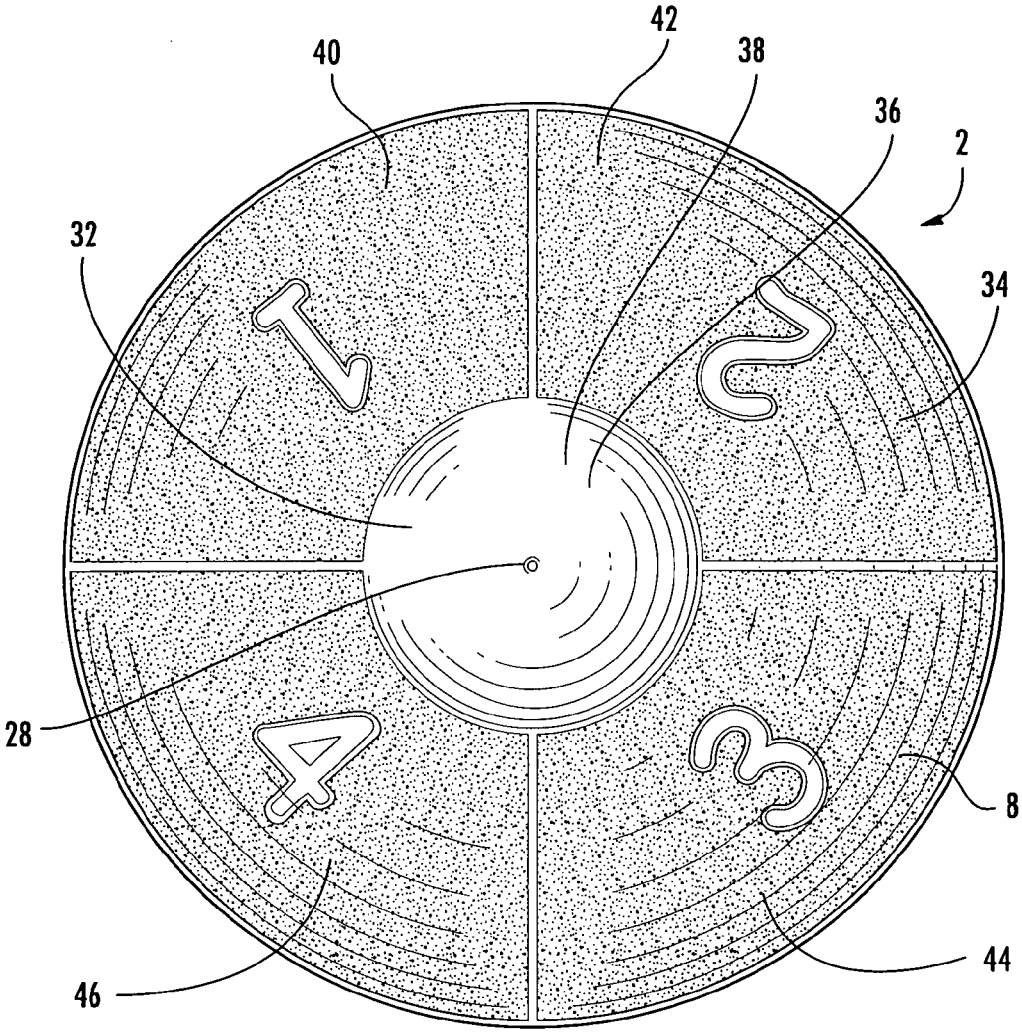
FIG. 3 is a top view of the training device of FIG. 2.
Figure 4:
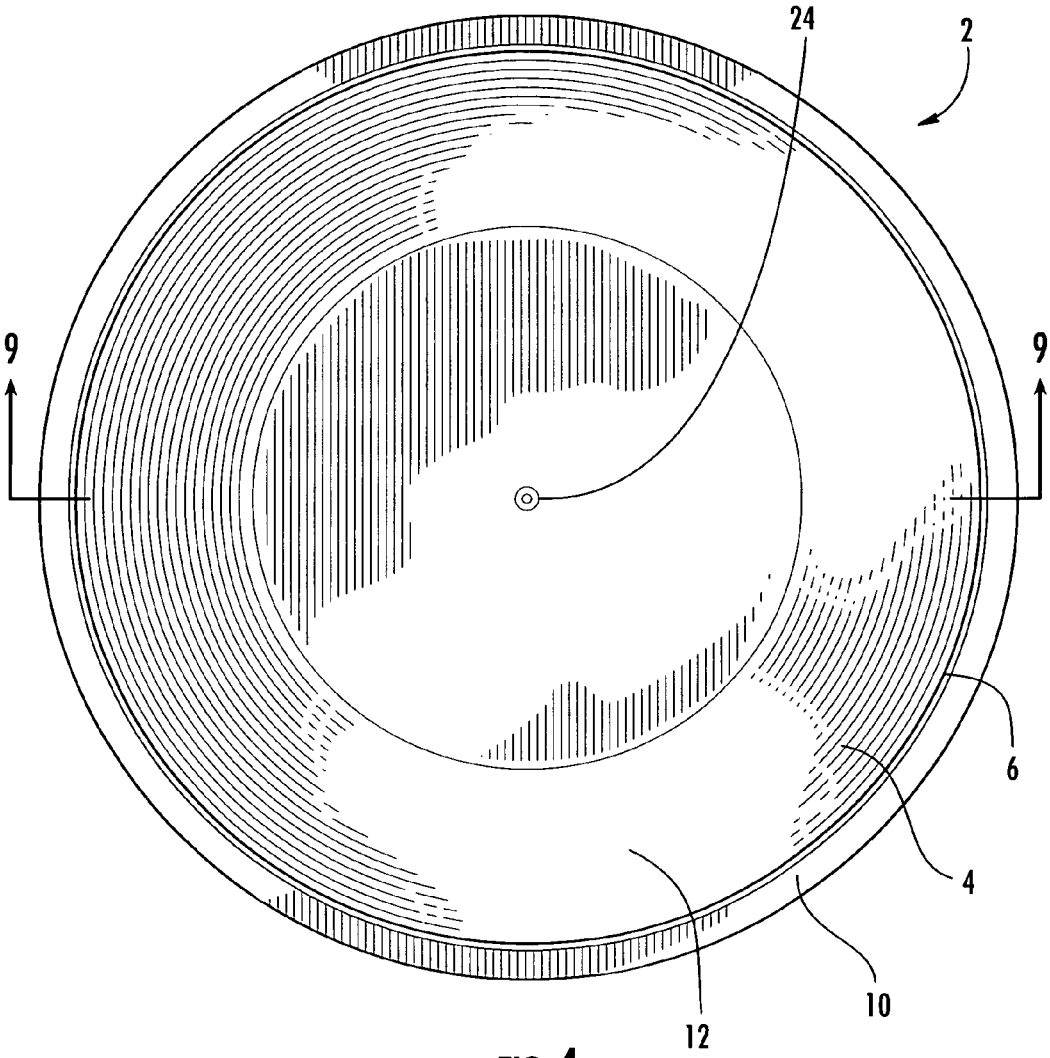
FIG. 4 is a bottom view of the training device of FIG. 2.
Figure 5:
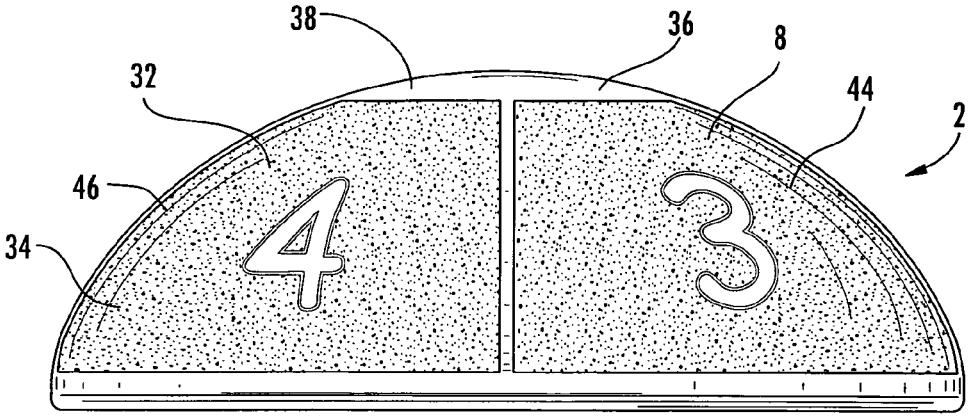
FIG. 5 is a side view of the training device of FIG. 2.
Figure 6:
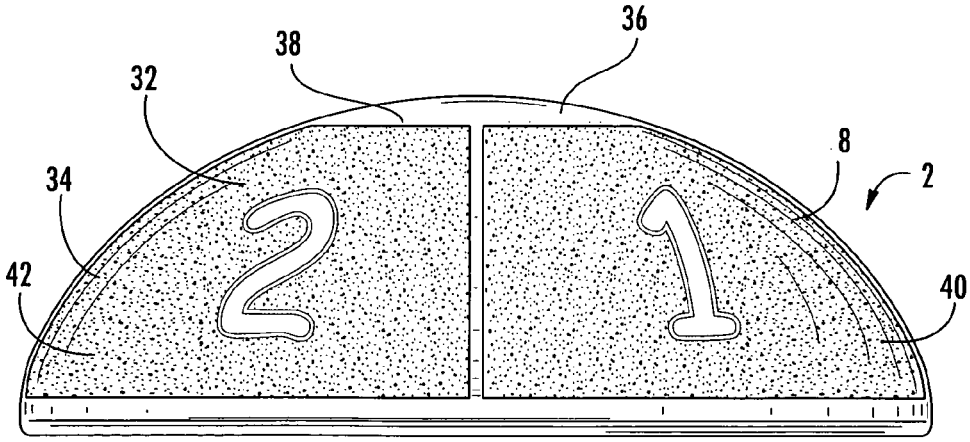
FIG. 6 is a side view of the training device of FIG. 2, from a different angle than shown in FIG. 5.

While the improved training device 2 has been specifically shown and described herein as being embodied in a circular-like article formed of flexible material such as polyvinyl chloride ("PVC"), it is not desired or intended to thereby unnecessarily limit the invention by reason of such restricted disclosure. It is furthermore contemplated that certain descriptive terms used herein shall be given the broadest possible interpretation consistent with the disclosure.

Referring to the drawings, and particularly FIGS. 2-11*b* thereof, the improved training device 2 shown therein is fabricated of flexible material. In the particular embodiment shown, the training device 2 includes a generally circular shaped base 4 being formed preferably of a semi-rigid PVC material. The base 4 is either seated on or in close proximity to the floor. The circumference of the base 4 is defined by a generally circular shaped rim 6.

The present invention also incorporates a flexible concave shaped dome 8 formed preferably of more flexible PVC material for stepping on by a user. A bumper ring 10, in the preferred embodiment an integrated portion of the dome 8, wraps around the rim 6 of the base 4 and is attached to at least a portion of the bottom surface 12 of the base 4 to enclose an inner area 14. In light of the similarities of the materials that make up the base 4 and the dome 8, the base 4 and dome 8 components are preferably fused together. This can be accomplished utilizing a rotational molding process. The fusion of the dome 8 and base 4 components functions to improve the integrity of the entire training device 2 by preventing the separation of the seal between the dome 8 and base 4 components.

In one embodiment of the present invention, the dome 8 has a bottom surface 16 that generally covers the same surface area as the base 4 and is seated onto the top surface 18 of the base 4. In this embodiment, an inner area 14 is created solely within the dome 8. This feature helps to ensure that the dome 8 maintains its integrity by preventing the loss of air because the inner area is created solely by the dome 8, which is formed as one piece, without the concern for inadvertent openings that can form at the joints or connection points when two separate materials are connected.

Unlike the prior art device 20 shown in FIG. 1, the contoured shaped of the present invention and the location of the bumper ring 10, eliminates the need for the thick and hard protruding ring structure 22 that surrounds the prior art device 20. Accordingly, the present invention is safer and easier to use that the prior art device 20 and provides a larger area that can be utilized by the user.

In one preferred embodiment of the present invention, the bottom surface 12 of the base 4 has a slight concave curving. In this embodiment of the invention only the bumper ring 10 is in contact with the floor, whereas the center of the base 4 is not in contact with the floor when the device 2 is not being used. The concave shape of the base 4 and the flexible material used to create the device 2 allows the device 2 and specifically the bumper ring 10 to create a suction effect when used on a hard flat surface. The suction effect can be activated by the user by simply stepping onto the device 2. Specifically, when the concave base 4 is pushed down by the weight of the user, air that is trapped between the floor and the base 4 is forced out from under the bumper ring 10. Then, the bumper ring 10 reseats itself on the floor and a vacuum is created that holds the device 2 in the desired position.

Figure 9:
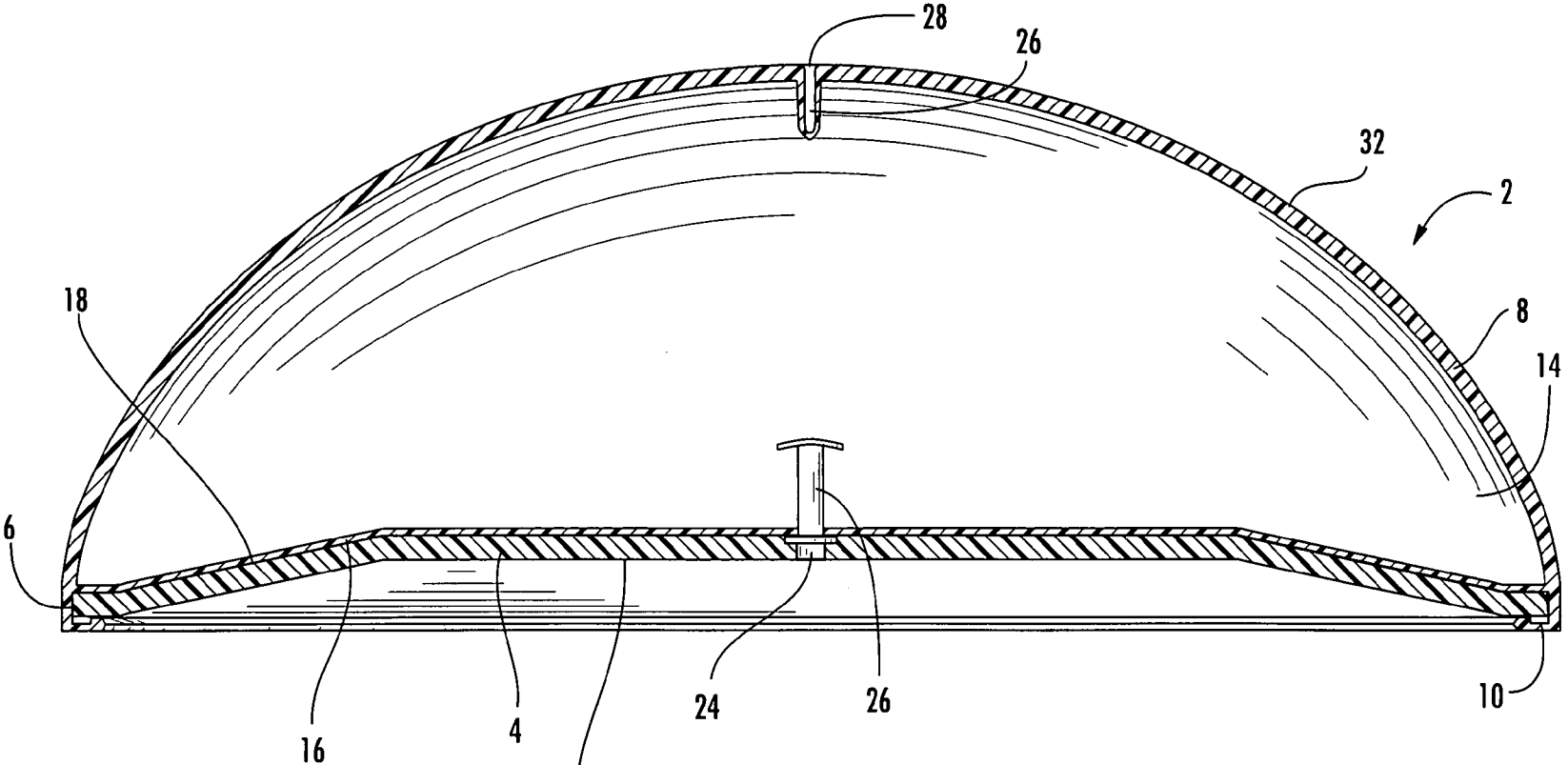
FIG. 9 is a cross-sectional view of the training device along lines 9-9 of FIG. 4.

In one aspect of the invention there is a first air valve 24 located in the base 4, preferably generally at the center, for allowing air to flow into and out of the inner area 14. First air valve 24 is preferably a high volume valve with a plug that allows for the use of high-volume pumps to quickly inflate the device 2. Referring to FIG. 9, the housing 26 for the first valve 24 is preferably integrated within the inner area 14 of the device 2. The first air valve 24 is preferably made of flexible material, which may be the same material as that forming the base 4. The first air valve 24 is preferably formed integrally with the base 4. The first air valve 24 can be closed with a plug (not shown) that can be inserted into the first air valve 24.

In another aspect of the invention there is a second valve 28 located at the top of the dome 8 that allows air to flow into and out of the inner area 14 of the training device 2. Referring to FIG. 9, the housing 30 for the second valve 28 is preferably integrated within the inner area 14 of the device 2. The second valve 28 is preferably made of flexible material, which may be the same material as that forming the dome 8. The second valve 28 is preferably formed integrally with the dome 8. The second valve 28 is preferably constructed so that it is flush with the outer surface 32 of the dome 8.

In one preferred embodiment, the training device 2 incorporates two valves, a first valve 24 located in the center of the base 4 and a second valve 28 at the top of the dome 8. In this embodiment, the first valve 24 is the primary, high volume valve that allows the user to quickly inflate or deflate the device 2. The second valve 28 is easily accessible by the user, permits air to flow into and out of the training device 2 at a slower rate of speed than the first valve 24 and allows for fine adjustment of the firmness of the training device 2. The presence of the second valve 28 alleviates the need to flip the entire device 2 over to adjust the firmness of the device 2.

In another embodiment of the invention, the dome 8 is constructed of multi-textures of both high-traction material 34 and low-traction material 36. The high-traction material 34 is designed to provide a non-slip surface and is created by utilizing material that is not smooth or that possesses crevices that create a greater surface area to the desired portion of the outer surface 32 of the dome 8. On the other hand, the low traction material 36 is designed to allow users to make turns without fear of the rubber soles of shoes being held in place by extreme friction. For example, in this embodiment of the invention, the top portion 38 of the outer surface 32 of the dome 8 can be constructed of smooth low-traction material 36 constructed of PVC, whereas the remainder of the dome can be constructed of high-traction material 34, also constructed of PVC.

Alternatively, the dome 8 may be constructed of a unitary material, but with high-traction areas 34 and low-traction areas 36. Similar to the embodiment described above, the high-traction area 34 is designed to provide a non-slip surface and is created by molding material in a manner that results in a surface that is not smooth or possesses crevices or rises that create a greater surface area in the desired portion of the outer surface 32 of the dome 8. The low traction area 36 is designed to allow users to make turns without fear of their shoes or feet being held in place by extreme friction, and is created by keeping the desired portion of the outer surface 32 of the dome 8 smooth.

Figure 8:
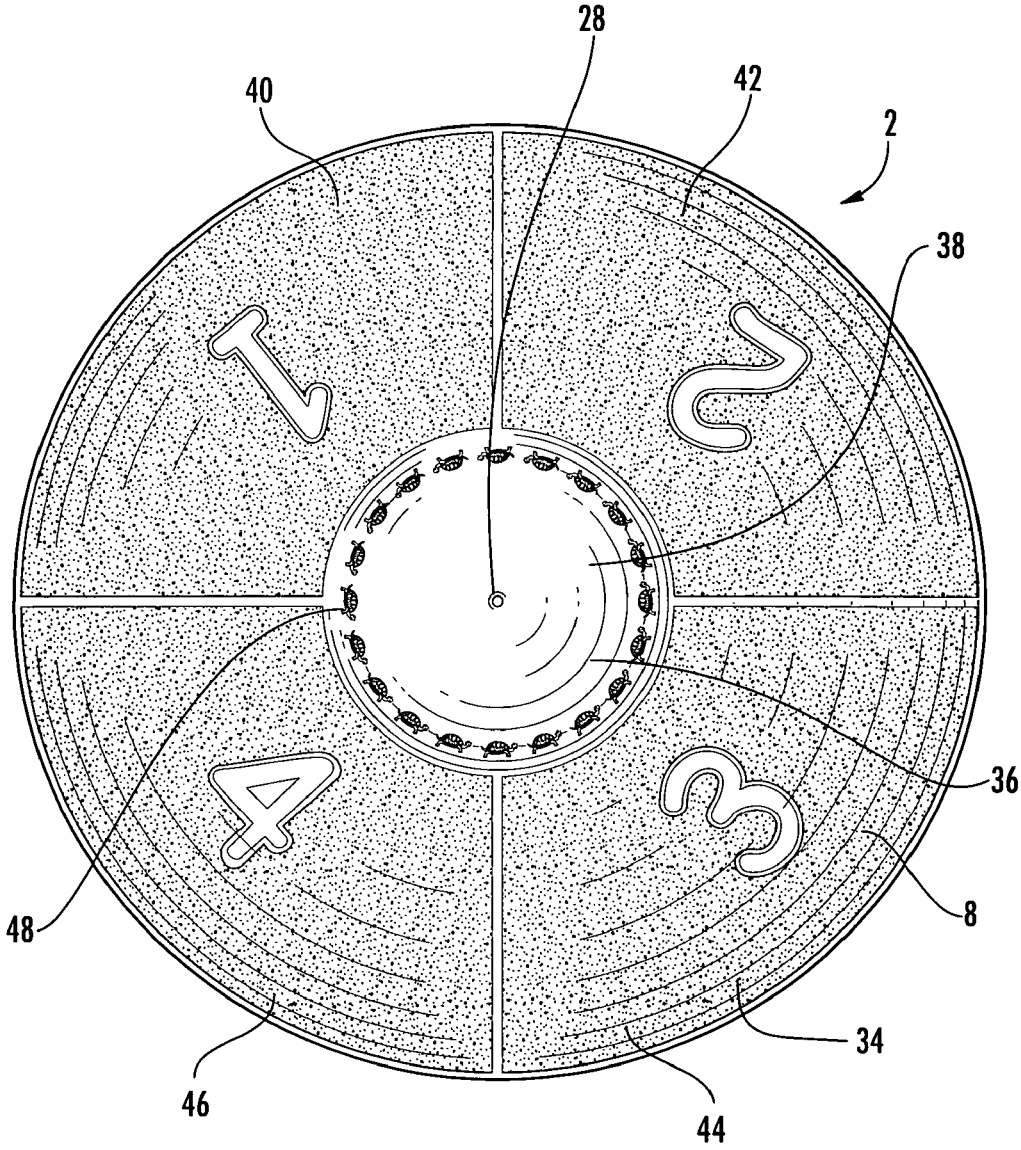
FIG. 8 is a top view of one embodiment of the training device according to the present invention.

The training device 2 of the present invention may have other applications aside from use in connection with exercise in a health club or home setting. For example, the training device 2 may also be used in the educational setting. As shown in FIG. 8, the dome 8 can be designed with elements for instructional purposes. For example, the dome 8 can incorporate four numbered quadrants, quadrant one 40, quadrant two 42, quadrant three 44 and quadrant four 46, integrated into the dome 8. The numbered quadrants can be incorporated into the dome 8 in any number of ways. For example, the numbers located on the dome 8 can appear in different colors or textures than the remainder of the dome 8. As described above, the top portion 38 of the dome 8 may be formed with low-traction areas 36 and a significant portion of the remainder of the dome 8 is comprised of high-traction areas 34. However, to distinguish between the separate quadrants, low-traction area 36 can be utilized between the quadrants. Additionally, to number the various quadrants on the dome 8, the numerals can also be created as a low-traction area 36.

While the improved training device 2 has been specifically shown and described herein with four quadrants, it is not desired or intended to thereby unnecessarily limit the invention by reason of such disclosure. For example, the device 2 can be configured without any quadrants, with more than four such areas, with less than four such areas, without numerals, or without any instructional elements whatsoever. Alternatively, other instructional elements can be incorporated on the training device 2.

Furthermore, the dome 8 can also be designed with directional elements 48 that show the user the clockwise or counter-clockwise direction that the user should be moving. As shown in FIG. 8, decorative designs, such as turtles, can serve as directional elements 48. While the improved training device 2 has been specifically shown and described herein with decorative turtle designs located near the top portion 38 of the dome 8, it is not desired or intended to thereby unnecessarily limit the invention by reason of such disclosure. For example, the device 2 can be configured with directional elements 48 located on another portion of the training device 2 or without any directional elements 48 whatsoever. Alternatively, other directional elements 48 can be utilized to assist the user, such as arrows, lines, shapes, other decorative designs, and the like.

The training device 2 of the present invention may have other applications aside from use in connection with a step exercise routine. For example the device 2 of the present invention can be used, for example, to perform push-ups, sit-ups and the like. The training device 2 of the present invention is a stable and safe device by allowing the bumper ring 10 to form a secure grip and prevent the device from sliding or moving on the floor as it is used. Alternatively, the entire device 2 can be used in an inverted position as a device to improve balance and strength.

Figure 7:
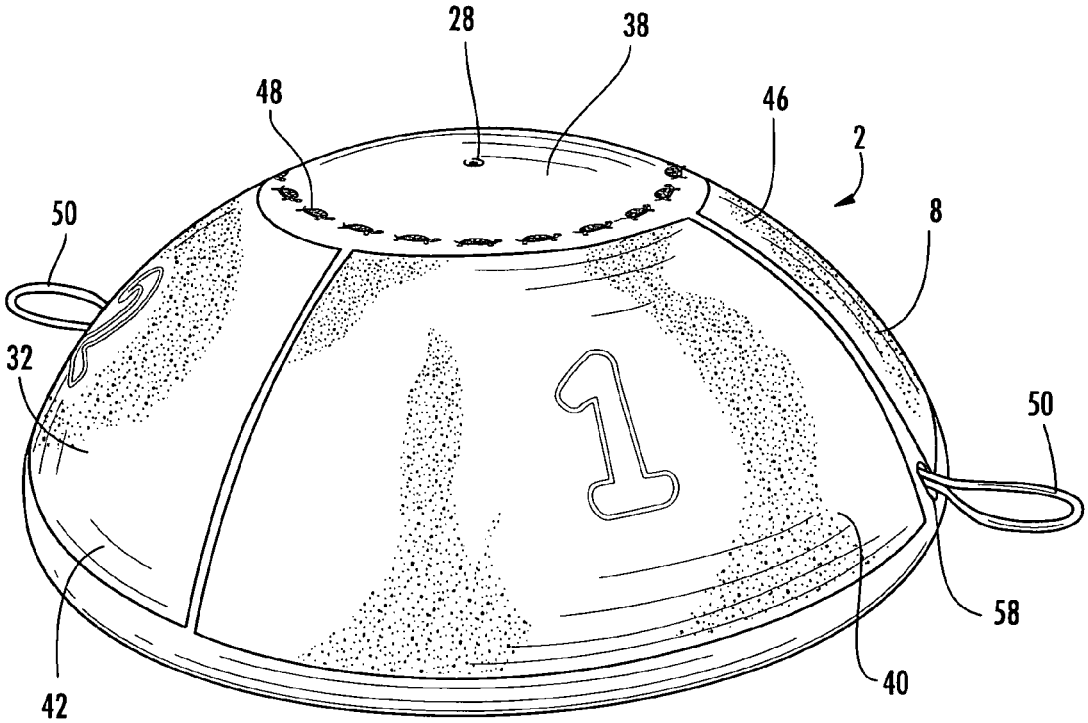
FIG. 7 is a perspective view of one embodiment of the training device according to the present invention.

In another embodiment of the present invention, at least one handle can be incorporated within the device 2 so that the device is easily transported. As shown in FIG. 7, at least one loop handle 50 can be attached to the device 2 for moving or hanging the device 2 for storage. In this embodiment, the loop handle 50 can be constructed of, for example, plastic, nylon, rope, metal wire, or any combination of these materials. In one embodiment of the invention, the loop handle 50 is formed of wire and encased with flexible PVC material. In another embodiment of the invention, the loop handle 50 can be internally anchored to the device 2 using a valve and plug arrangement. In such an arrangement, the loop handle 50 would be connected to a plug. The plug would be inserted into an opening 52 in the dome 8. As demonstrated in FIG. 7, multiple loop handles 50 can be incorporated into the device 2.

Figure 10:
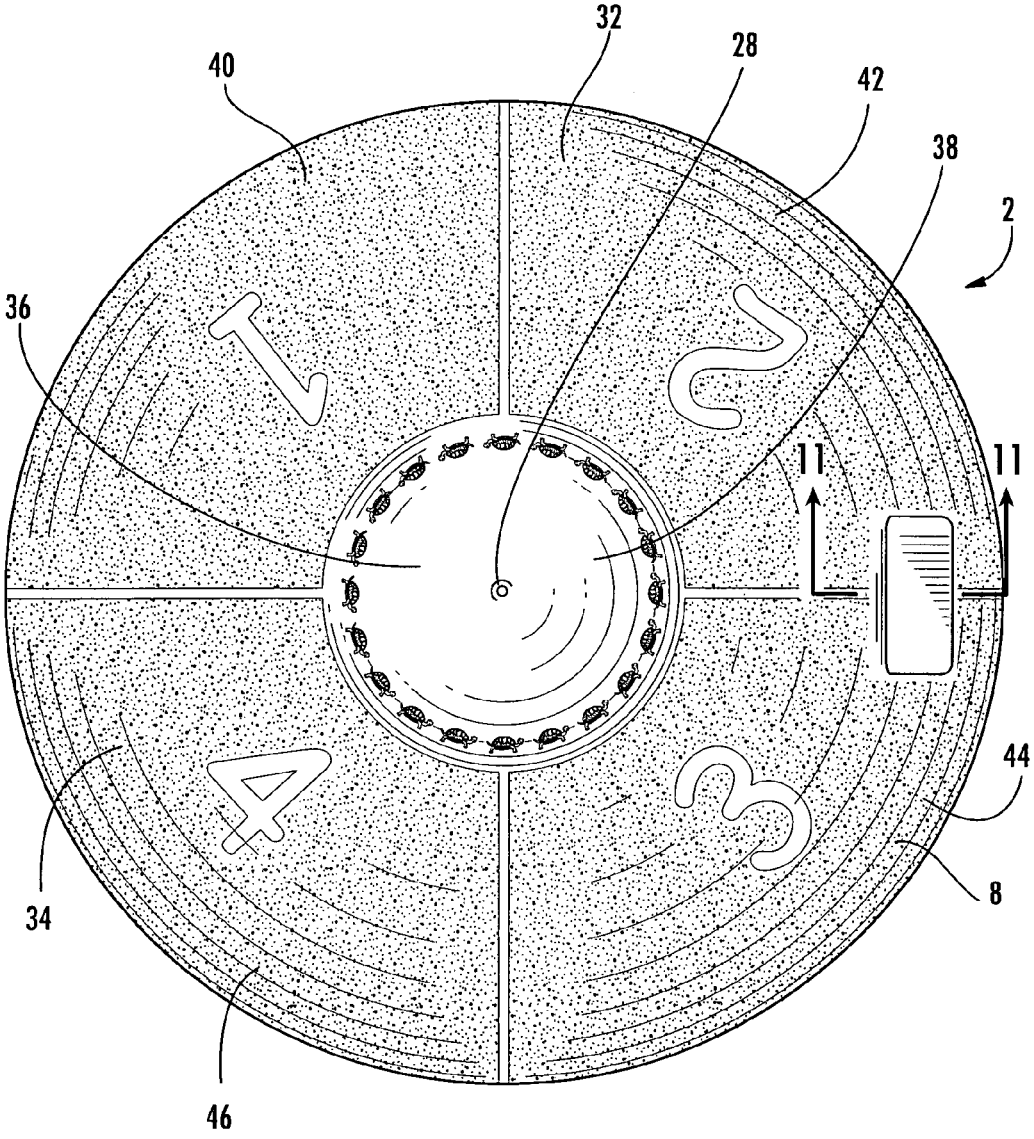
FIG. 10 is a top view of one embodiment of the training device according to the present invention.
Figure 11A:
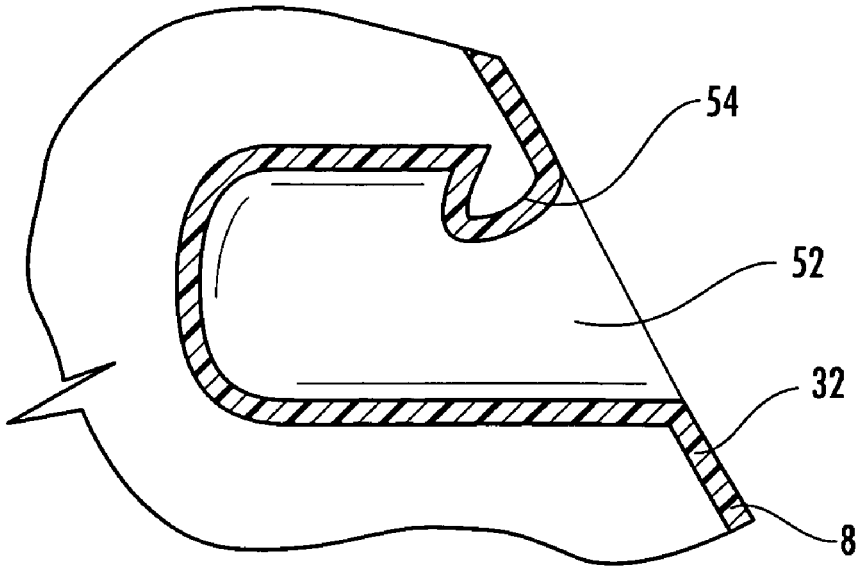
FIG. 11*a* is a cross-sectional view of a portion of the training device along lines 11-11 of FIG. 10.
Figure 11B:
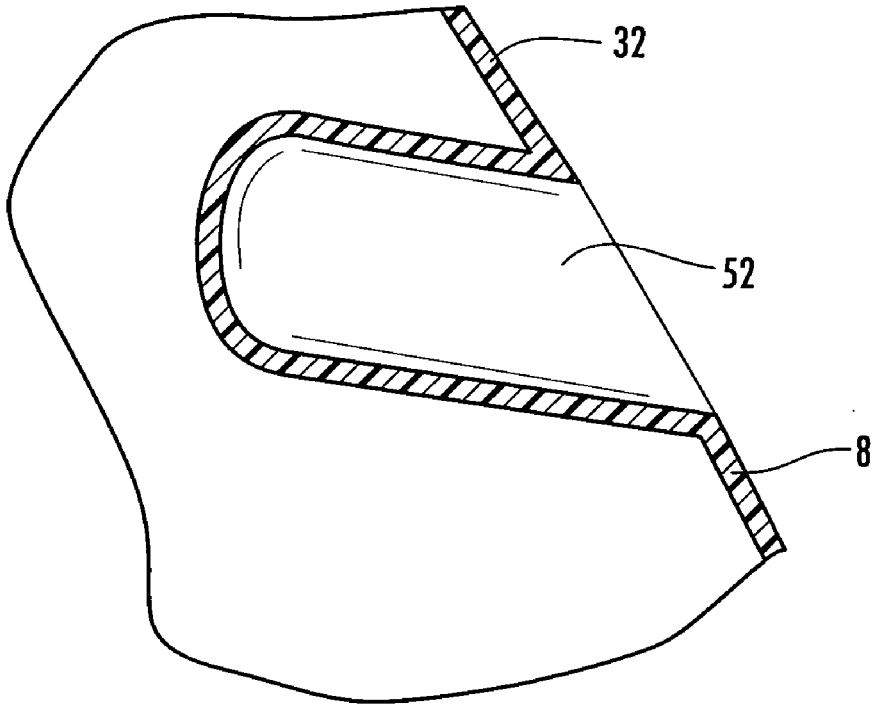
FIG. 11*b* is a cross-sectional view of a portion of another embodiment of the training device along lines 11-11 of FIG. 10.

In another embodiment of the present invention, as shown in FIG. 10, at least one built-in handle 54 is formed integrally with the dome 8 so that the device is easily transported. As further demonstrated in FIGS. 11*a* and 11*b* the built-in handle 52 can incorporate certain additional features that further improve the ability of the user to transport the training device 2. For example, as demonstrated in FIG. 11*a*, a nub 56 can be incorporated into the built-in handle 54. The nub serves to provide a location to allow the user to better grasp the device with the user's hand. As demonstrated in FIG. 11*b*, the built-in handle 54 can also be formed on an angle to allow the user to easily transport the device 2. Alternatively, a combination of the use of the nub 56 as demonstrated in FIG. 11*a* and the slanted handle design demonstrated in FIG. 11*b* can be utilized.

The training device 2 of the present invention may have other applications aside from use in connection with exercise and educational training. The invention may be implemented in a variety of configurations, using certain features or aspects of the several embodiments described herein and others known in the art. Thus, although the invention has been herein shown and described in what are perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter disclosed herein and set forth in the claims.

Additionally, benefits, advantages, and solutions to the problems with the prior art devices have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

The invention claimed is:

1. A training device for use on a floor which comprises:

a generally circular shaped base comprising a generally circular shaped rim defining the circumference of the base, a top surface and a bottom surface; and a flexible concave shaped dome comprising an outer surface for stepping on by a user, a generally planar bottom surface that is positioned on top of the top surface of the base and a bumper ring formed by a portion of the dome that wraps around the rim of the base and is attached to at least a portion of the bottom surface of the base, wherein the dome encloses a inner area and only the bumper ring engages the floor when the device is oriented with the bottom surface of the base toward the floor.

2. The training device of claim 1 wherein said base is at least slightly concave to create an air pocket defined by the base, the bumper ring and the floor, wherein the air that is trapped within the air pocket is forced out between the bumper ring and the floor when pressure is applied to the dome and the bumper ring forms a seal with the floor.

3. The training device of claim 1 wherein the base and dome are fused together using a rotational molding process.

4. The training device of claim 1 wherein the base and dome are constructed of polyvinyl chloride.

5. The training device of claim 1 wherein the dome is constructed of a combination of high-traction and low-traction materials.

6. The training device of claim 1 further comprising instructional elements to assist the user with the use of the device.

7. The training device of claim 1 further comprising directional elements to assist the user with the use of the device.

8. The training device of claim 1 further comprising a handle.

9. The training device of claim 8 further comprising:

an opening in the dome;

a plug that can be inserted into said opening; and a carrying handle that is anchored to said plug.

10. The training device of claim 1 further comprising a first air valve which provides air communication with the inner area through the base.

11. The training device of claim 10 further comprising a second air valve which provides air communication with the inner area through the dome.

* * * * *